US012378037B2

(12) United States Patent
Riggan

(10) Patent No.: US 12,378,037 B2
(45) **Date of Patent: *Aug. 5, 2025**

(54) RECEPTACLE SYSTEM WITH DIVIDER INSERT

(71) Applicant: ALTAFRESH LLC, Chelan, WA (US)

(72) Inventor: Mac Riggan, Wenatchee, WA (US)

(73) Assignee: Altafresh LLC, Chelan, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/428,577

(22) Filed: Jan. 31, 2024

(65) Prior Publication Data

US 2024/0166408 A1 May 23, 2024

Related U.S. Application Data

(63) Continuation of application No. 17/438,390, filed as application No. PCT/US2020/022759 on Mar. 13, 2020, now Pat. No. 11,919,677.

(60) Provisional application No. 62/817,958, filed on Mar. 13, 2019.

(51) Int. Cl.

| | |
|---|---|
| ***B65D 25/04*** | (2006.01) |
| ***A47G 19/22*** | (2006.01) |
| ***B65D 1/26*** | (2006.01) |
| ***B65D 25/08*** | (2006.01) |

(52) U.S. Cl.

CPC ..... *B65D 25/08* (2013.01); *A47G 19/2205* (2013.01); *B65D 1/265* (2013.01)

(58) Field of Classification Search

CPC ..... A47G 2019/2277; A47G 19/03; A47G 19/04; A47G 19/2205; B65D 1/265; B65D 1/26; B65D 2209/00; B65D 25/04; B65D 25/08

USPC ..... 220/529, 521, 575, 530, 592.17; 206/524.6

See application file for complete search history.

(56) References Cited

U.S. PATENT DOCUMENTS

| | | | | |
|---|---|---|---|---|
| 2,335,016 A * | 11/1943 | Lorenzen | ..... | B65D 25/04 220/524 |
| 5,405,030 A | 4/1995 | Frazier | | |
| 5,934,501 A | 8/1999 | Wright et al. | | |
| 6,295,831 B1 * | 10/2001 | Watson | ..... | F25D 3/08 220/592.16 |

(Continued)

FOREIGN PATENT DOCUMENTS

| | | |
|---|---|---|
| KR | 10-2004-0010338 | 1/2004 |
| WO | WO 2004/008924 | 1/2004 |

OTHER PUBLICATIONS

International Search Report for PCT Application No. PCT/US2020/022759, dated Jun. 12, 2020, 2 pp.

(Continued)

*Primary Examiner* — King M Chu
(74) *Attorney, Agent, or Firm* — Richard T. Black; FisherBroyles, LLP

(57) ABSTRACT

A receptacle system includes a cup configured to hold consumable items and has a bottom surface and an interior. A dividing element is disposed within the cup interior and defines first and second chambers. A receptacle system includes a cup configured to hold consumable items and has a bottom surface and an interior. A dividing element is disposed within the cup interior and is configured to maintain disposable items separate from the consumable items.

3 Claims, 5 Drawing Sheets

(56) References Cited

U.S. PATENT DOCUMENTS

| | | | | |
|---|---|---|---|---|
| 7,975,868 | B1 | 7/2011 | Flies et al. | |
| 8,998,021 | B2 | 4/2015 | Saxena | |
| 9,718,582 | B2 | 8/2017 | Hylton | |
| 2012/0267378 | A1* | 10/2012 | Hays | A47G 19/2288 220/592.17 |
| 2014/0158694 | A1 | 6/2014 | Martin | |

OTHER PUBLICATIONS

Written Opinion For PCT Application No. PCT/US2020/022759, dated Jun. 12, 2020, 3 pp.

* cited by examiner

RECEPTACLE SYSTEM WITH DIVIDER INSERT

PRIORITY CLAIM

This patent application is a continuation of U.S. patent application Ser. No. 17/438,390 filed Sep. 10, 2021, which is a National Stage Entry of PCT Application No. PCT/US20/22759 filed Mar. 13, 2020, which claims priority to U.S. Provisional Patent Application No. 62/817,958 filed Mar. 13, 2019, all of which are hereby incorporated by reference in their entireties as if fully set forth herein.

BACKGROUND

Soft seed or pit bearing fruits (such as cherries, apricots, peaches and the like) while popular for their taste, create the problem of disposal of the pit (or stone or seed). As a result of this inconvenience, some consumers opt to not consume the fruit. Similarly, shelled nuts such as peanuts and sunflower seeds present the problem of disposal of the shells.

BRIEF DESCRIPTION OF THE DRAWINGS

Preferred and alternative embodiments of the present invention are described in detail below with reference to the following drawing figures.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with receptacles for holding fruits, nuts and other types of food items along with various lids for such receptacles, and including methods of making or using any of the above have not necessarily been shown or described in detail to avoid unnecessarily obscuring descriptions of the embodiments of the invention. For purposes of brevity and clarity, the following description will be directed to a receptacle system for holding cherries and disposing of cherry pits and/or stems, but it is to be understood that the receptacle system may be used for a wide variety of food items such as, but not limited to, nuts (e.g., pistachios and peanuts), sunflower seeds, other types fruits that have pits and/or stems, and shrimp or other types of peel-able seafood. More generally, the receptacle system may be used for any food that includes a consumable portion and a disposable portion.

Figure 1:
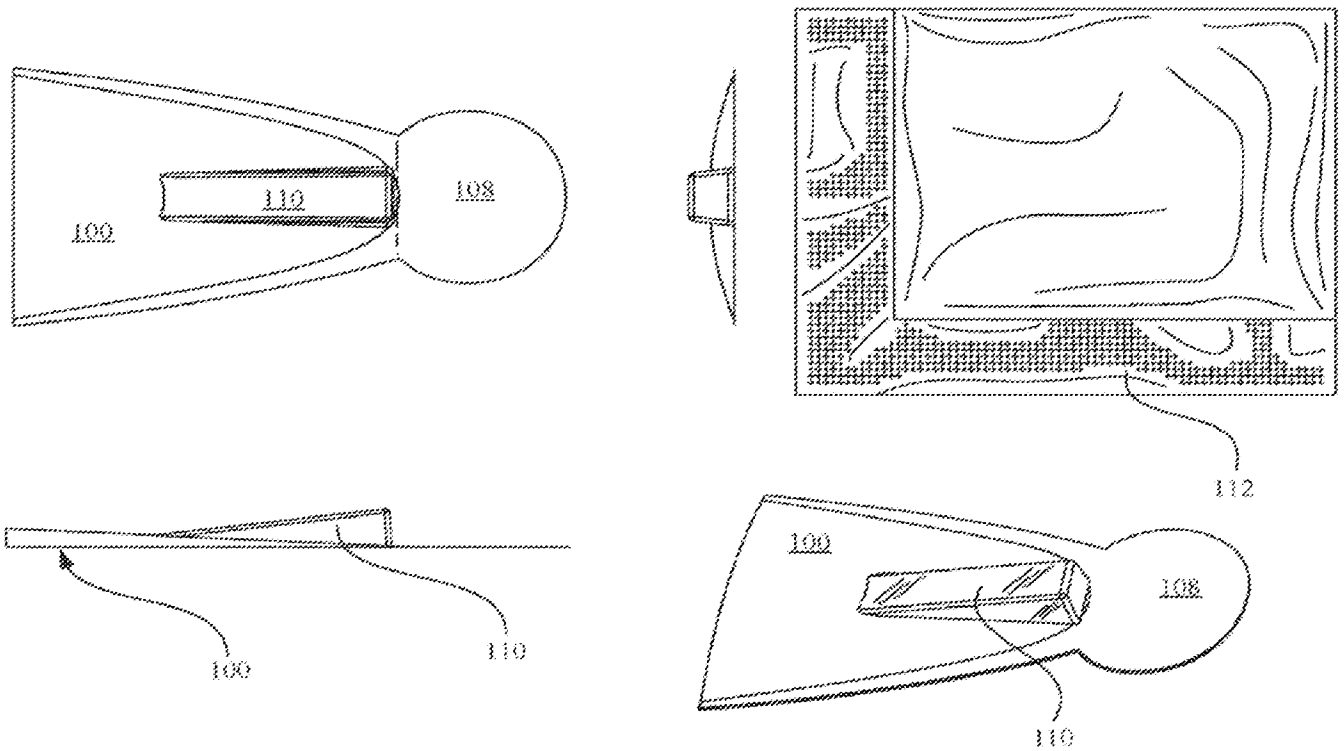
FIG. 1 shows a top plan view, side plan view and top perspective view of a dividing element for placement in a cup according to an embodiment of the present invention.
Figure 2:
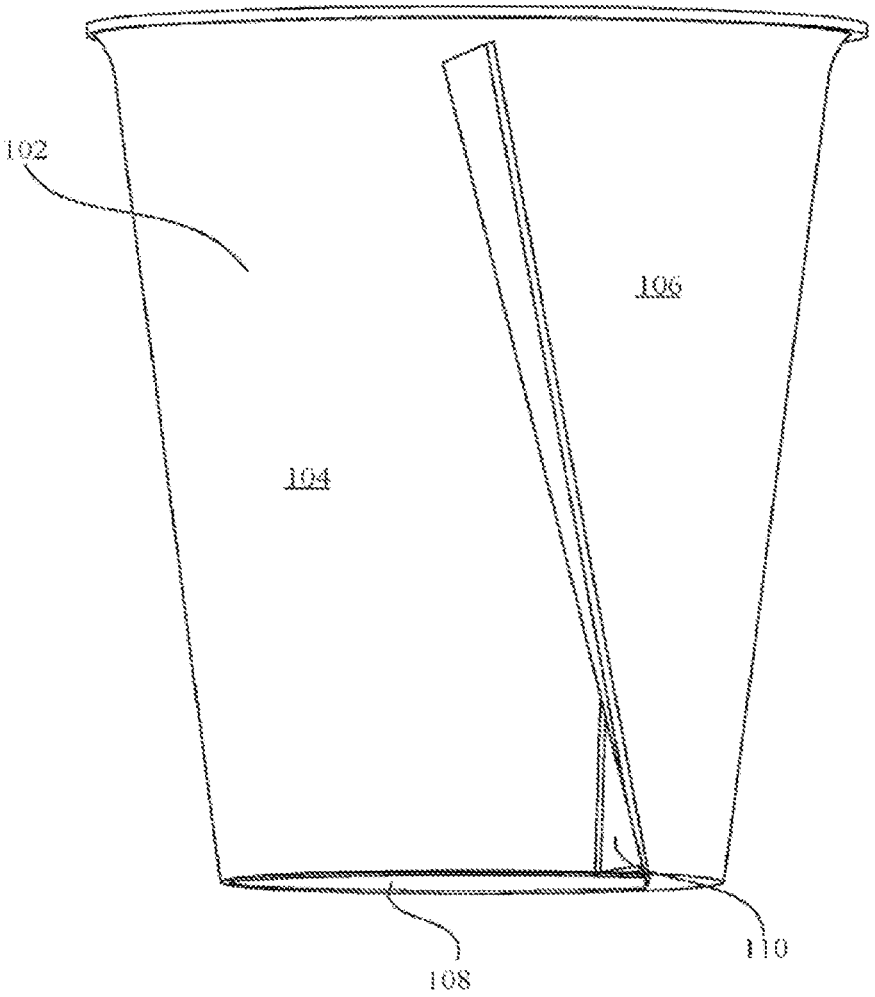
FIGS. 2-5 illustrate the dividing element of FIG. 1 deployed within the cup.
Figure 3:
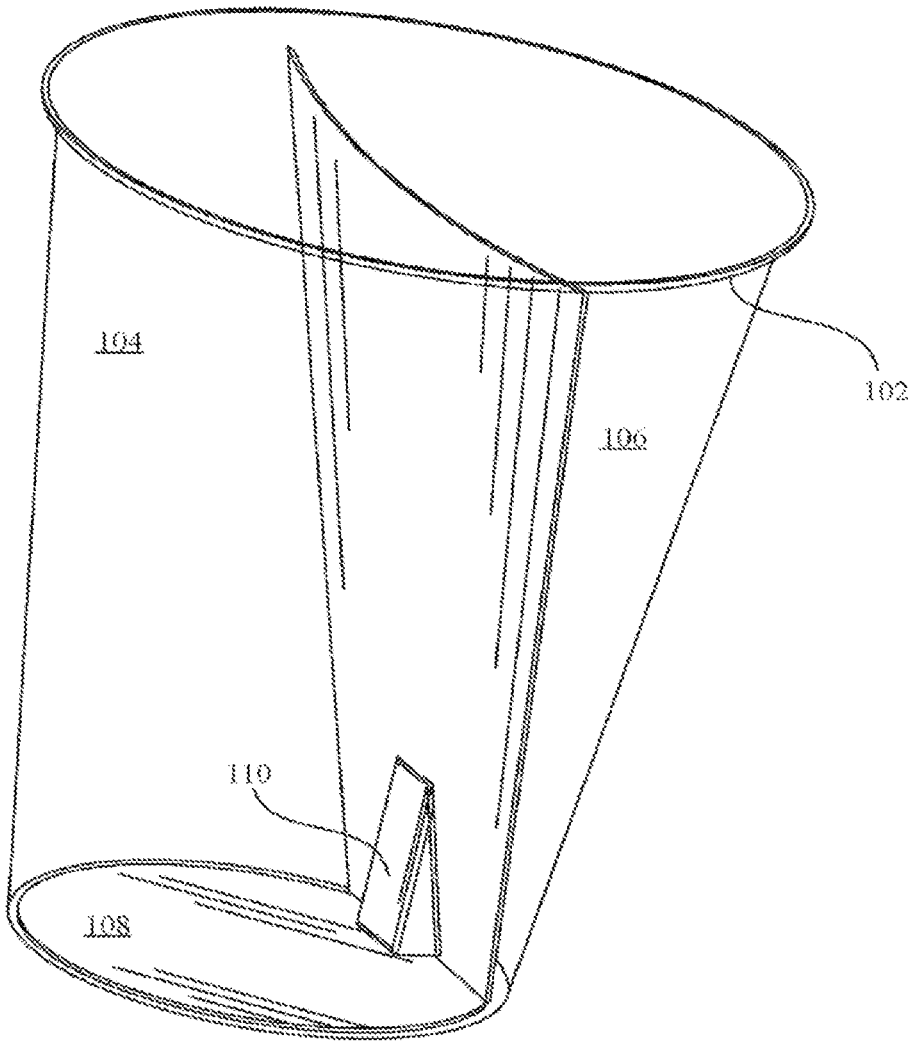
Figure 4:
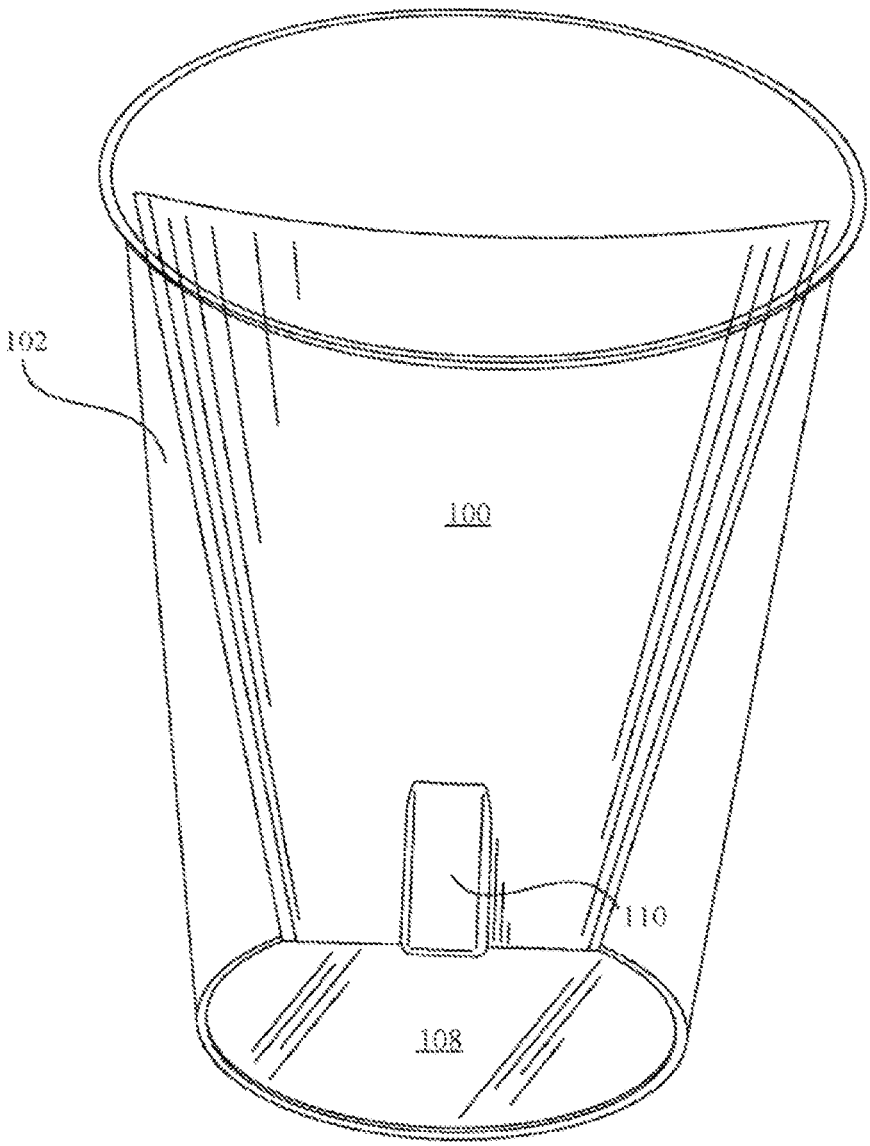
Figure 5:
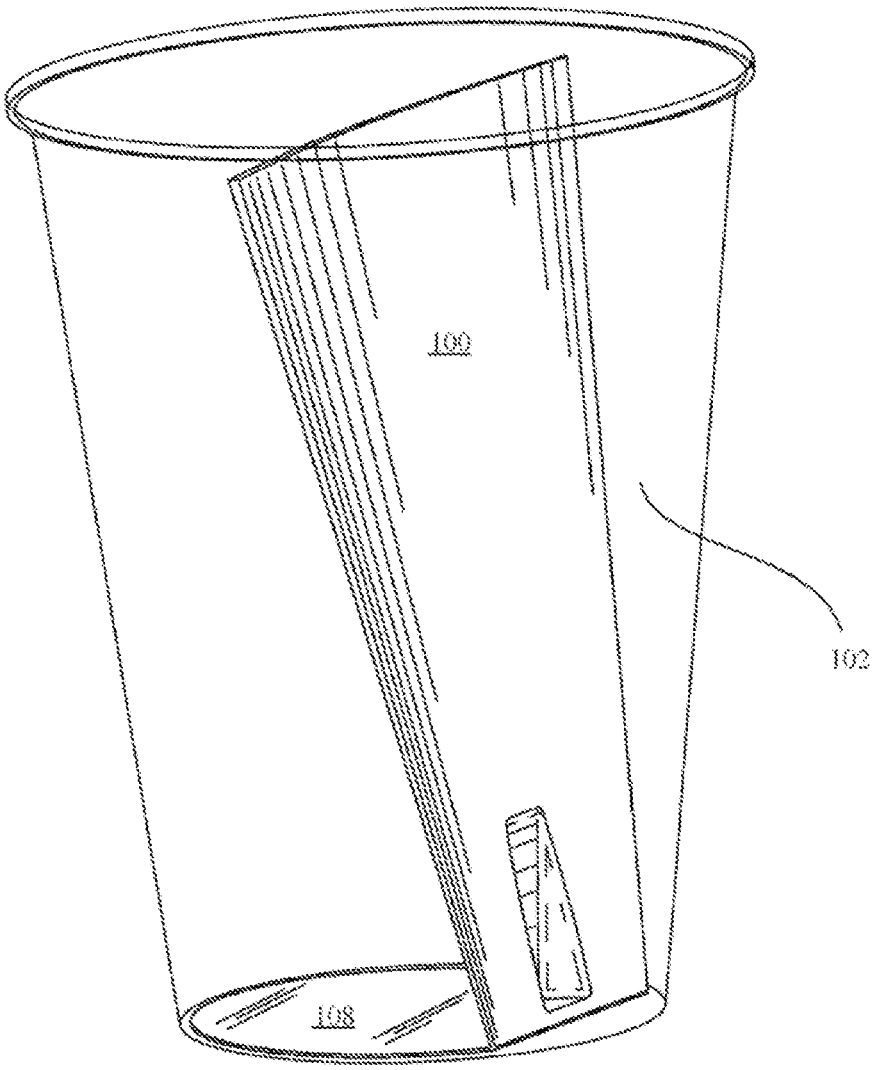

FIG. 1 shows a top plan view, side plan view and top perspective view of a dividing element main body 100 for placement in a cup 102 (best shown in FIGS. 2-5) so as to divide the cup into a first chamber 104 for receiving a plurality of consumable items (e.g., sunflower seeds) 104 and a second chamber 106 configured to receive a plurality of disposable items (e.g., seed hulls) according to an embodiment of the present invention. The dividing element main body 100 includes or is otherwise coupled to an insert bottom 108 and a bracing element 110. As illustrated in the Figures, in a preferred embodiment, the bracing element 110 is wedge-shaped. A heat-sealed film 112 can be placed between insert bottom 108 and the bottom of cup 102 to isolate the consumable items from moisture and oxygen.

FIGS. 2-5 illustrate the dividing element main body 100 deployed within the cup 102. As can be seen in the Figures, when the dividing element main body 100 is in its deployed state, the insert bottom 108 is folded up such that a bottom surface of the bracing element 110 rests against the insert bottom to promote structural integrity of the first and second chambers 104, 106. The second chamber 106 is configured to receive the disposable items while the dividing element main body 100 is shaped to provide a complete barrier between the disposable items and the consumable items in the first chamber 104. By way of example, the dividing element main body 100 permits users to consume sunflower seeds from the first chamber 104 and use the second chamber 106 to temporarily dispose of the shells without having to expel the shells onto the ground or into a trash receptacle. Further, the assembly of cup 102 and dividing element main body 100 allows for the consumption of the consumable item by tipping the cup 102 to the mouth while any shells remained self-contained in the second chamber 106.

In operation, a user may tilt the cup 102 and simply tip one or more of the consumable items from the first chamber 104 into his mouth. Once the consumable item has been eaten, the user may rotate the cup 102 and expel the disposable item into the second chamber 106. Once all the consumable items are gone, or when the second chamber 106 is full, the user may discard the disposable items and re-use the cup 102. Notably, the user may advantageously accomplish this operation with a single hand without any mess or fuss.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

I claim:

1. A receptable system comprising:

consumable items;

a cup configured to hold the consumable items and having a bottom surface and an interior;

a dividing element disposed within the cup interior and defining the first and second chambers, the dividing element being configured to maintain a complete barrier between the first and second chambers, the consumable items being present in only the first chamber-; and wherein the dividing element further comprises a wedge-shaped bracing element.

2. The system of claim 1, wherein the dividing element further comprises:

an insert bottom; and wherein the wedge-shaped a bracing element rests against the insert bottom.

3. The system of claim 2, further comprising a heat-sealed film positioned between the insert bottom and the bottom surface of the cup.

* * * * *